United States Patent [19]

Rossi

[11] 3,991,654

[45] Nov. 16, 1976

[54] HYDRAULIC SYSTEM FOR USE IN ENGINES HAVING RECIPROCATING PISTONS AND ROTARY PISTON RODS

[76] Inventor: Joseph M. Rossi, 2015 Cedar Ave., Scranton, Pa. 18505

[22] Filed: Mar. 4, 1975

[21] Appl. No.: 555,170

Related U.S. Application Data

[63] Continuation-in-part of Ser. No. 296,548, Oct. 11, 1972, abandoned.

[52] U.S. Cl. ..... 91/186; 91/468; 92/33; 92/73; 92/153; 417/245; 417/380

[51] Int. Cl.[2] ..... F01B 31/10; F01B 3/00; F01B 1/02

[58] Field of Search ..... 92/33, 73; 91/417 R, 91/183, 188, 152, 186, 468; 417/245, 380, 392

[56] References Cited

UNITED STATES PATENTS

| | | | |
|---|---|---|---|
| 2,665,555 | 1/1954 | Martinsson | 91/417 R |
| 3,192,783 | 7/1965 | Cruzan | 92/33 |
| 3,388,603 | 6/1968 | Clark | 92/33 |
| 3,393,610 | 7/1968 | Aarvold | 92/33 |

FOREIGN PATENTS OR APPLICATIONS

| | | | |
|---|---|---|---|
| 1,271,224 | 7/1961 | France | 91/183 |

*Primary Examiner*—Paul E. Maslousky
*Attorney, Agent, or Firm*—Brady, O'Boyle & Gates

[57] ABSTRACT

A hydraulic system for use in engines having reciprocating pistons and rotary piston rods wherein hydraulic fluid is supplied to each cylinder to not only lubricate the piston and cylinder but also to facilitate the movement of the piston to the top dead center position.

2 Claims, 6 Drawing Figures

HYDRAULIC SYSTEM FOR USE IN ENGINES HAVING RECIPROCATING PISTONS AND ROTARY PISTON RODS

Cross-Reference to Related Applications

This application is a continuation-in-part of application Ser. No. 296,548, filed Oct. 11, 1972, now abandoned.

The hydraulic system of the present invention is adapted to be employed in engines of the type described in my copending application Ser. No. 296,547, filed Oct. 11, 1972, now U.S. Pat. No. 3,916,866 dated Nov. 4, 1975, wherein the piston is slidably mounted on the piston rod so that reciprocation of the piston on the piston rod imparts a rotary motion to the piston rod which is geared to the engine drive shaft.

Background of the Invention

In engines of the type having each piston slidably mounted on its respective piston rod for imparting rotary motion to the piston rod which drives the engine drive shaft, in order to return the piston to the top dead center position, it is necessary to provide the drive shaft with a counterweight or conventional fly wheel. While the counter-weight accomplishes its intended function, it does not prove completely satisfactory in that unnecessary vibrations are developed in the engine.

To overcome the attendant disadvantages caused by the use of fly wheels or counter-weights to return the piston to the top dead center position, the hydraulic system of the present invention has been devised which comprises, in one embodiment, a hydraulic system communicating with the lower end of each cylinder whereby as the piston in a first cylinder is moved to the top dead center position, hydraulic fluid is drawn from a reservoir into the first cylinder, and, during the power stroke, as the piston moves from the top dead center position to the bottom of the cylinder, the hydraulic fluid is forced from the cylinder into the lower end of the next succeeding cylinder in the operating cycle of the engine to cause its piston to move to the top dead center position, whereby the hydraulic fluid is not only employed as a source of pressure for forcing the pistons to the top dead center position but it also acts as a lubricant for the cylinders and pistons.

In another embodiment of the invention, the hydraulic reservoir is pressurized, whereby pressurized hydraulic fluid is forced into each cylinder of the engine to cause the respective pistons to move to the top dead center position, and during the power stroke of each piston the hydraulic fluid in each cylinder is exhausted back into the pressurized reservoir.

Figure 1:
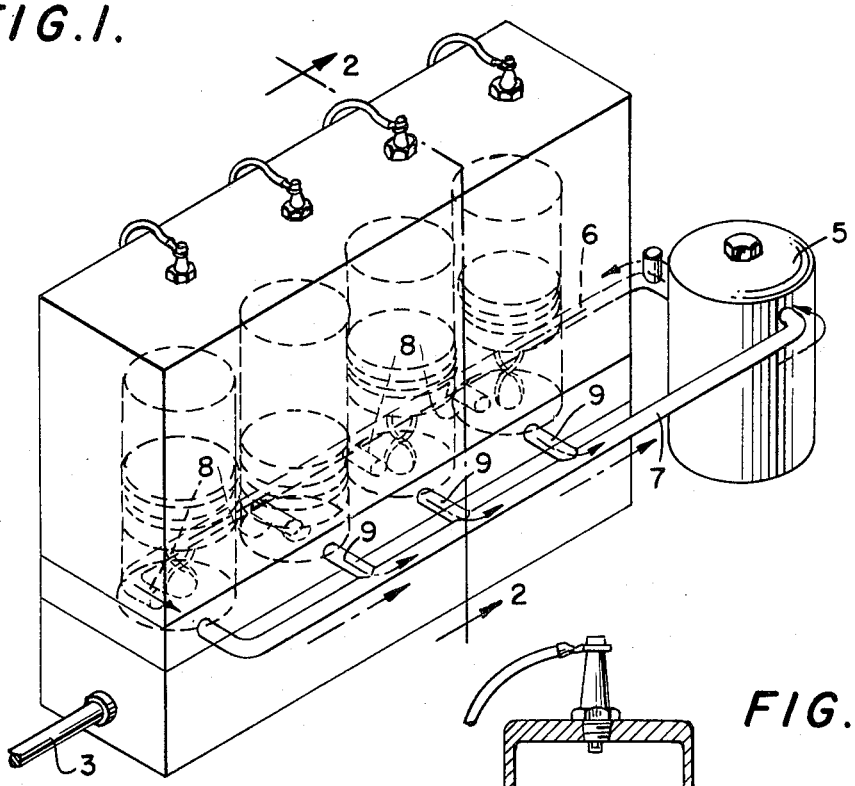
FIG. 1 is a perspective view of an engine employing the pressurized hydraulic system of the present invention.
Figure 2:
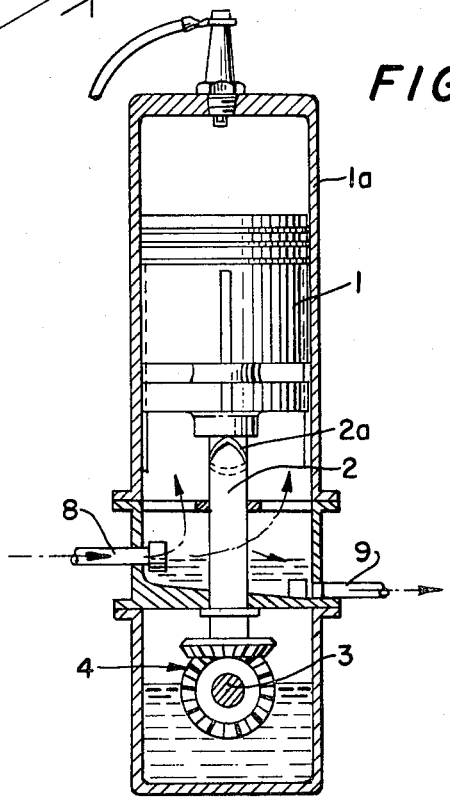
FIG. 2 is a view taken along line 2—2 of FIG. 1.

Referring to the drawings and more particularly to FIGS. 1 and 2, the hydraulic system of the present invention is adapted to be employed in an engine of the type described in my copending application Ser. No. 296,547, filed Oct. 11, 1972, wherein a piston 1 is slidably mounted on a piston rod 2 to impart rotary motion thereto, the piston rod being connected to the engine drive shaft 3 by suitable gears 4 whereby the rotary motion of the piston rod is imparted to the engine drive shaft. The reciprocation of the piston 1 imparts rotary motion to the shaft 2 by means of a detent assembly carried by the piston which engages a spiral groove 2*a* formed on the piston rod. On its power stroke, the piston is driven downwardly on the piston rod to thereby drive the piston rod and associated drive shaft.

Figure 5:
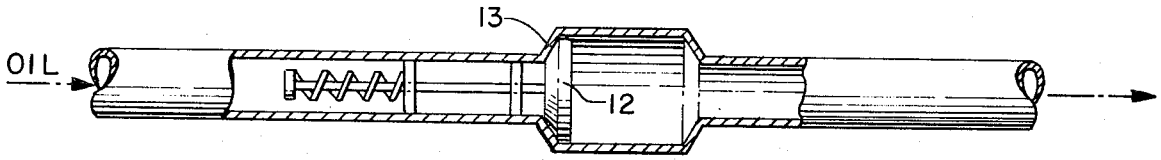
FIG. 5 is a side elevational view, partly in section, showing a check valve employed in the hydraulic systems.

To return the piston to the upper end of the cylinder 1a or to the top dead center position, a fly wheel (not shown) is connected to the shaft 3 and the hydraulic system of the present invention has been provided which comprises, in one embodiment, an accumulator 5 (FIG. 1), having a supply manifold 6 and an exhaust manifold 7, the lower end portions of each of the cylinders 1a communicating with the respective manifolds by branch lines 8 and 9. As will be seen in FIG. 6, suitable check valves 10 and 11 are provided in the branch lines 8 and 9 to prevent reverse flow of the hydraulic fluid in the respective lines. While various types of check valves may be employed, a preferred type is shown in FIG. 5 wherein the valve head 12 is spring biased to the closed position against a seat 13 formed on the wall of the branch line.

Figure 6:
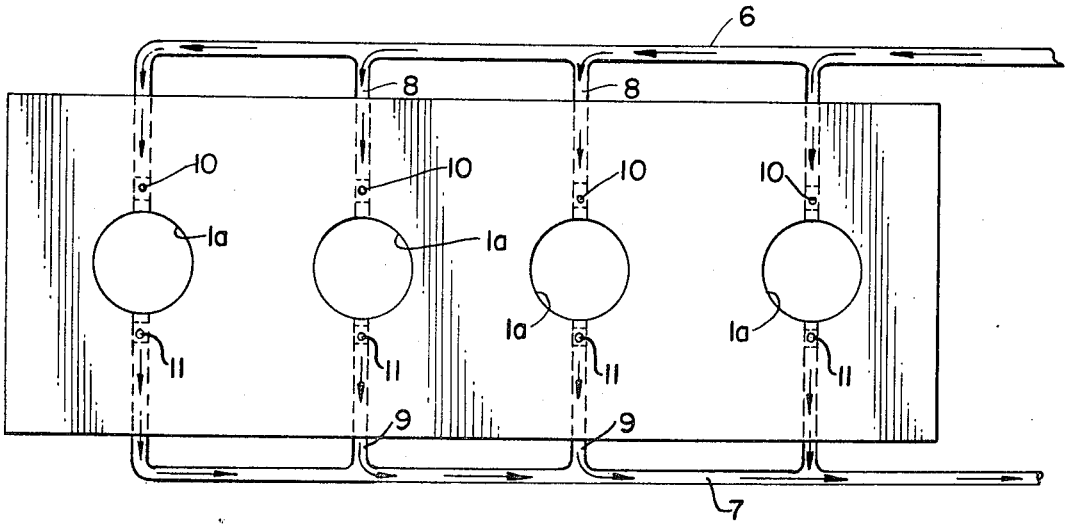
FIG. 6 is a top plan view of the engine shown in FIG. 1 showing the flow path of the pressurized hydraulic system.

In the operation of the hydraulic system shown in FIGS. 1 and 6, pressurized hydraulic fluid enters each cylinder through branch line 8 to force the respective piston to the upper end of the cylinder. During the power stroke, the piston forces the hydraulic fluid out of the cylinder through branch line 9 and back to the accumulator 5.

Figure 3:
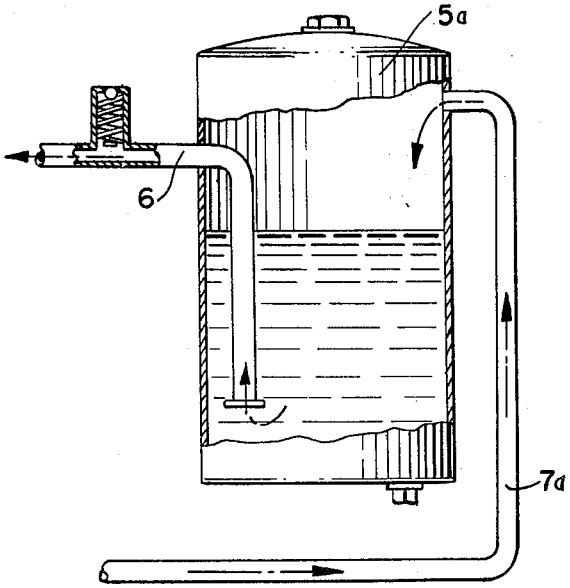
FIG. 3 is a fragmentary, sectional view of the reservoir employed in the unpressurized hydraulic system of the present invention.
Figure 4:
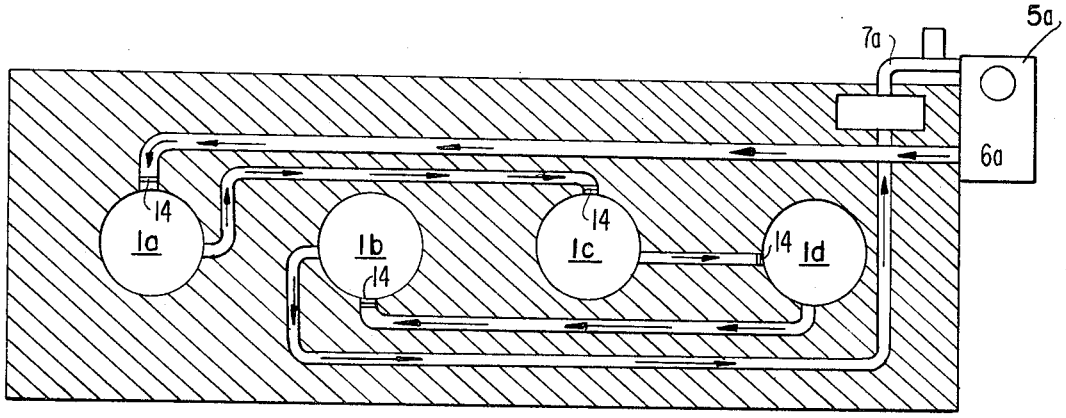
FIG. 4 is a sectional top plan view of an engine employing the unpressurized hydraulic system.

Another embodiment of the hydraulic system is illustrated in FIGS. 3 and 4 wherein the hydraulic fluid is stored in an unpressurized reservoir 5a and the hydraulic fluid is supplied to each piston sequentially according to the particular cycle of the operation of the engine. In this arrangement, a volume of hydraulic fluid, equal substantially to the volume of the portion of the cylinder 1a between the bottom face of its respective piston at the top dead center position and the bottom wall of the cylinder, is drawn from the reservoir 5a through line 6*a* to cylinder 1*a* as the piston in cylinder 1a moves to the top dead center position. During the power stroke, the piston in cylinder 1a forces the volume of fluid therefrom into cylinder 1c causing its piston to move to the top dead center position, the fluid then being exhausted sequentially to cylinders 1d and 1b to cause their respective pistons to move to the top dead center positions in the same manner as described above with regard to cylinders 1a and 1c, the fluid flowing in the path indicated by the arrows and returning to the reservoir 5a through return line 7*a*, the flow paths being provided with suitable check valves 14 to prevent reverse flow of the hydraulic fluid in the respective lines.

From the above description, it will be appreciated by those skilled in the art that the hydraulic system of the present invention not only provides a source of pressure for facilitating the movement of the pistons to the top dead center position but it also provides a source of lubrication for the pistons, piston rods and cylinders. While, for purposes of illustration, the hydraulic system of the present invention has been shown employed in internal combustion engines, it is contemplated that the system can be employed in other types of engines such as steam, pneumatic, hydraulic and the like, wherein the piston is slidably mounted on the piston rod to impart rotary motion thereto.

It is to be understood that the form of the invention herewith shown and described is to be taken as a preferred example of the same, and that changes in the shape, size and arrangement of parts may be resorted to, without departing from the spirit of the invention or scope of the subjoined claims.

I claim:

1. In a multi-cylinder engine having a piston slidably mounted on a piston rod in each cylinder to impart rotary movement to said piston rod operatively connected to a drive shaft including a fly wheel for moving the piston to a bottom dead center position, and a driving fluid provided above the piston to move the piston to a bottom dead center position during a top stroke, the improvement comprising, an unpressurized hydraulic system operatively connected to the piston rod side of the pistons for not only lubricating the piston and cylinder but also to facilitate the movement of the pistons toward the top dead center position, said hydraulic sysyem including a reservoir, a supply line from the reservoir connected to the piston-rod side of one of the cylinders, check valve means mounted in said supply line, an exhaust line connected between the piston-rod side of another cylinder and the reservoir, an exhaust line connected between the piston-rod side of said one cylinder and the piston-rod side of one of the remaining cylinders, additional supply and exhaust lines connected between the piston-rod side of the remaining cylinders disposed between the first and second mentioned cylinders, said additional supply and exhaust lines being connected to the respective cylinders in accordance with the particular operating cycle of the engine such that the exhaust lines in said one of the remaining cylinders and in each of the succeeding remaining cylinders also function as the supply line for the next succeeding cylinder in the operating cycle, and check valve means mounted in said additional supply and exhaust lines, whereby when the piston in the first-mentioned cylinder moves to the top dead center position a volume of hydraulic fluid is drawn from the reservoir into the piston-rod side of said first cylinder, during the power stroke of the piston in said first cylinder the volume of fluid being exhausted therefrom into the piston-rod side of the next remaining cylinder and successively to the other remaining cylinders in the order of the operating cycle of the engine thereby forcing the respective pistons to the top dead center position.

2. In a multi-cylinder engine according to claim 1, wherein the volume of hydraulic fluid drawn from the reservoir is equal substantially to the volume of the portion of the cylinder between the bottom face of its respective piston at the top dead center position and the bottom wall of the cylinder.

* * * * *